US005695086A

United States Patent [19]

Viola

[11] Patent Number: 5,695,086

[45] Date of Patent: Dec. 9, 1997

[54] CLOSURE DEVICE FOR PET FOOD CANS

[76] Inventor: Charles A. Viola, 511 S. 2nd St., Fairfield, Iowa 52556

[21] Appl. No.: 680,474

[22] Filed: Jul. 15, 1996

[51] Int. Cl.[6] ..... B65D 41/01; B65D 51/00

[52] U.S. Cl. ..... 220/287; 220/793; 220/376; 215/319; D9/451

[58] Field of Search ..... 446/71, 73, 74, 446/267; 239/211; 222/18; 215/228, 11.6, 12.1, 11.1, 319; 220/212, 212.5, 287, 780, 793, 796, 805, 376, 285; D9/451, 310

[56] References Cited

U.S. PATENT DOCUMENTS

| | | | |
|---|---|---|---|
| D. 86,164 | 2/1932 | Griswold | D9/451 |
| D. 90,246 | 7/1933 | Hall | D9/451 |
| D. 101,048 | 9/1936 | Kessler | D9/451 |
| 893,464 | 7/1908 | Essmuller . | |
| 1,979,706 | 11/1934 | Reamy . | |
| 2,181,589 | 11/1939 | Silvette | 446/71 |
| 2,663,460 | 12/1953 | Keeney | 222/78 X |
| 2,731,751 | 1/1956 | Green | D9/451 X |
| 3,157,304 | 11/1964 | Judge | 215/319 |
| 3,606,074 | 9/1971 | Hayes . | |
| 3,655,089 | 4/1972 | Tower . | |
| 3,850,341 | 11/1974 | Bart . | |
| 3,921,801 | 11/1975 | Sway | 220/376 X |
| 4,595,111 | 6/1986 | Gould et al. | 220/285 X |
| 4,815,628 | 3/1989 | Wehnert, III | 220/805 X |
| 5,114,374 | 5/1992 | Estiva | 215/11.6 X |
| 5,312,010 | 5/1994 | Johnson | 220/793 |
| 5,540,611 | 7/1996 | Lapoint et al. | 446/74 X |

*Primary Examiner*—Allan N. Shoap
*Assistant Examiner*—Nathan Newhouse

[57] ABSTRACT

A closure device (10) for pet food cans comprising a central cover member (12) and an outer cover member (14) which are integrated into the shape of a pet having protruding features (16), said protruding features providing a means of prying the device. Extending downwardly from the cover members (12 and 14) are a plurality of concentric annular bands (18), each having a bead or rib (20) extending inwardly from the inner surface.

1 Claim, 3 Drawing Sheets

FIG.1
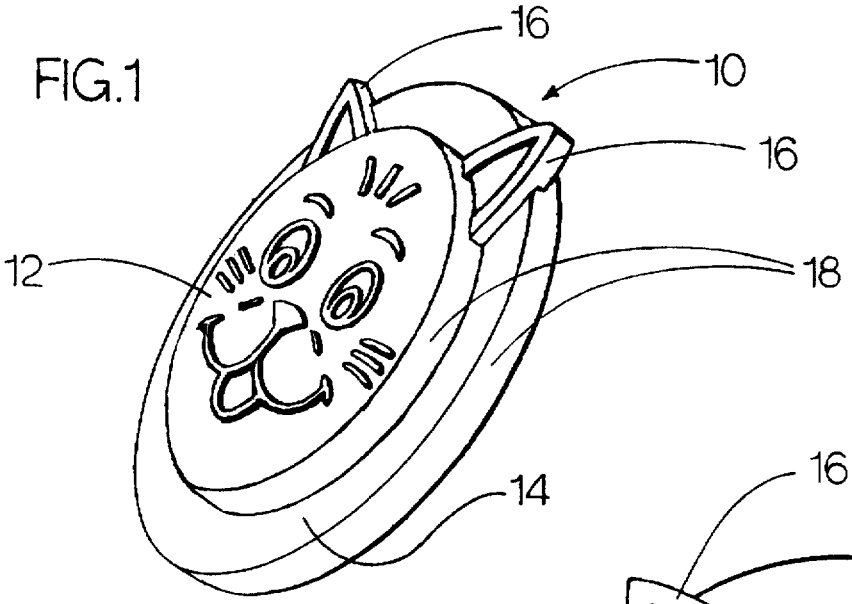
FIG.2
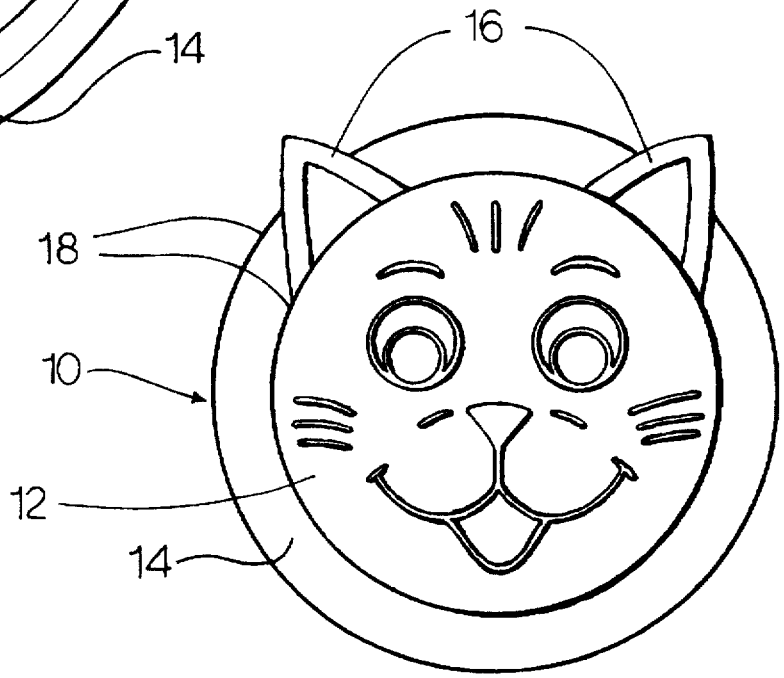
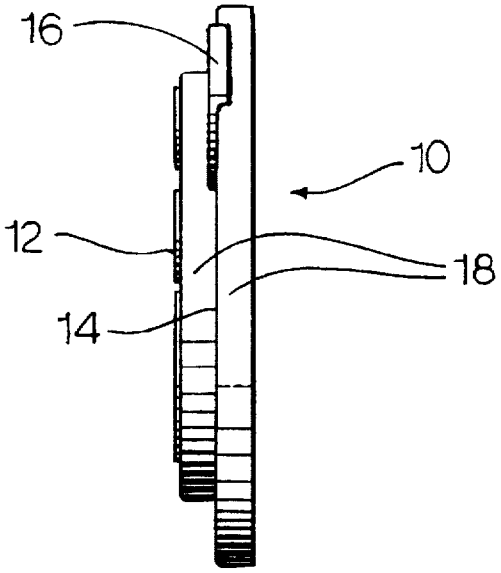
FIG.3

CLOSURE DEVICE FOR PET FOOD CANS

BACKGROUND—FIELD OF THE INVENTION

The invention disclosed herein is a device which may be used to close cans with openings of various sizes and includes a decorative surface which provides a means of prying the device from the cans. The invention addresses itself particularly to the need for a closure device which will effectively seal pet food cans which have openings of different sizes.

BACKGROUND—DESCRIPTION OF PRIOR ART

Pet food cans are commonly available with openings of various diameters. Users of canned pet food, therefore typically have a need to close a variety of cans with different size openings. By providing a single closure device with the capability to seal a multitude of different sized openings of pet food cans, the present invention eliminates the need for the ineffective methods of closure commonly resorted to by users of pet food cans. Such methods may include wrapping the cans with metal foil, plastic film, waxed paper, or covering the can with a lid that does not fit the dimensions of the can opening. Such inadequate methods of closing pet food cans may allow the food inside the can to be readily exposed to outside air, thereby hastening its spoilage and causing it to be wasted, as many pets will not consume food that shows signs of spoilage. In addition, such methods are inconvenient, time-consuming, and may result in the undesirable spreading of pet food odor.

There exist, in the field of prior art, numerous devices for closing containers of various sized openings. Such devices include U.S. Pat. No. 893,469 to Esmuller, U.S. Pat. No. 3,606,074 to Hayes, and U.S. Pat. No. 3,655,089 to Tower. However, all of these devices lack an inwardly extending bead or rib portion inside the gripping surfaces of the closure device, which would provide a means of effectively gripping the pet food can in such a manner as to prevent the can from slipping and falling if the user attempts to lift or carry the can by holding the closure device, as is often done by users of pet food cans.

In addition, the inventions of Tower and Hayes, lack an arrangement whereby gripping bands of extremely similar diameter may be included in the same device. This fault makes them unsuitable for use in closing pet food cans which have openings of a very similar diameter.

U.S. Pat. No. 1,979,706 to Reamy discloses an invention which provides an inwardly extending bead or rib portion, but only on one inner gripping surface and not on a plurality of inner gripping surfaces. Therefore it cannot effectively grip cans with openings of various diameters in such as manner as to keep them from slipping when lifted or held by the closure device.

U.S. Pat. No. 3,850,341 to Bart provides gripping surfaces of various diameters, each with an inwardly extending bead or rib portion, but, like the other inventions cited above, it does not provide an integrated means of prying the device from the can.

None of the aforementioned devices are integrated into the shape of a pet, the utility of which feature is described in the next section.

OBJECTS AND ADVANTAGES

The advantage of including an inwardly extending bead or rim around each gripping surface of the closure device is that such a feature insures a tight and secure seal around the lip of the opening of the typical pet food can. The applicant's invention allows the user to press the closure device onto the opening of the pet food can until it snaps securely into place. The closure device may then be lifted and carried without danger of accidental separation from the can. Due to the snugness of this sealing arrangement, the can may be stored with a minimum of exchange of air between the inside of the can and the environment, thereby protecting the contents from spoilage.

The multiple level arrangement of gripping surfaces of the applicant's device allows bands of very similar diameter to be included in the same closure device. This is an important feature because pet food cans commonly have openings of extremely similar diameters.

Integrating the means of closure into a device which has the shape of a pet provides several utilitarian advantages, the first being that it provides the means of prying the closure device from the can, as the protruding features of the pet shape afford a handle which can be easily grasped by the fingers of the user. Secondly, the pet shape identifies which type of pet food can the device is intended to close. Thirdly, the incorporating the closure device into the shape of a pet provides a distinct commercial value in that it increases the marketing appeal of the closure device.

DRAWING FIGURES

FIG. 1 is a perspective view of the invention, showing the top.

FIG. 2 is a plan view of the invention, showing the top.

FIG. 3 is a side elevational view of the invention.

DESCRIPTION OF THE INVENTION

Figure 4:
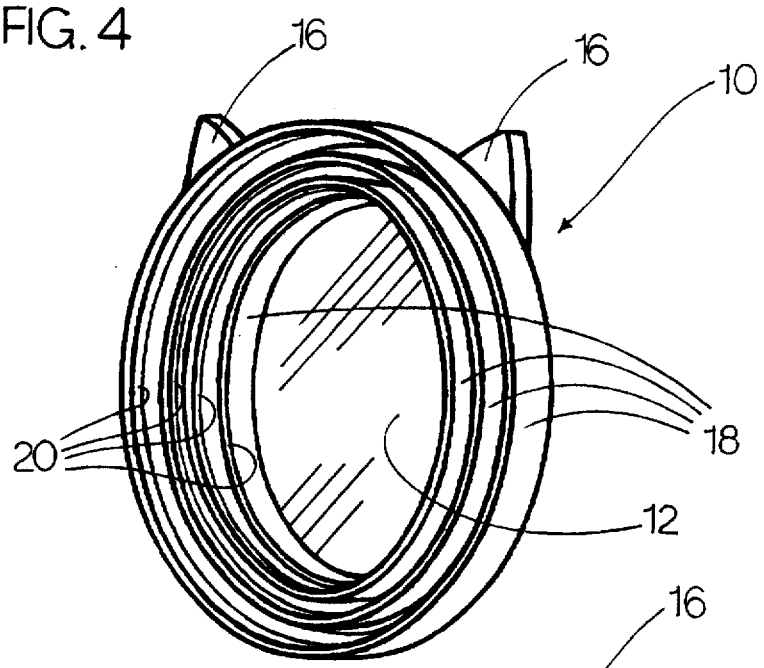
FIG. 4 is a perspective view of the invention, showing the bottom.
Figure 5:
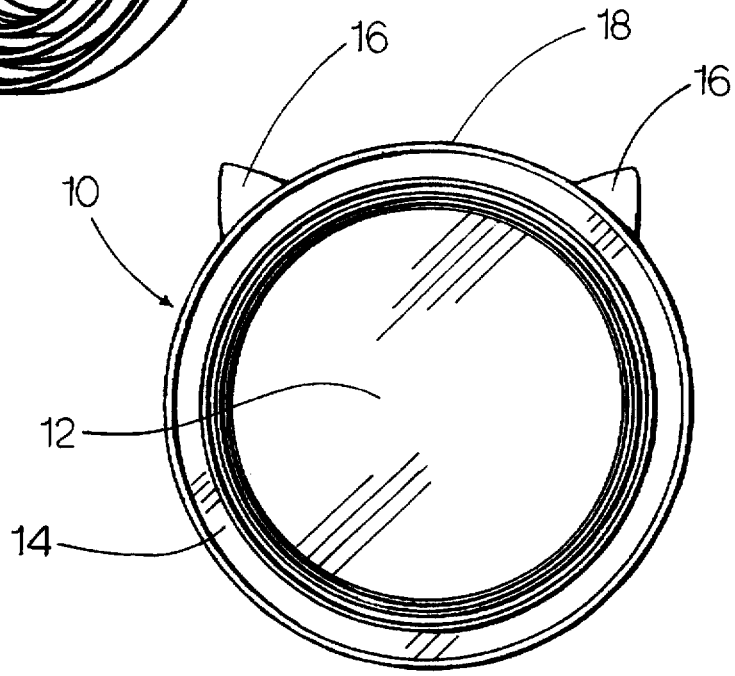
FIG. 5 is a plan view of the invention, showing the bottom.

The present invention 10 is a closure device for pet food cans of various size openings, made of a flexible material. In the preferred embodiment, the invention comprises a central cover member 12, the upper surface of which is formed in the shape of a pet. Surrounding said central cover member 12, and separated from it in elevation, is an outer cover member 14. From the outer cover member 14, protrude features resembling those of a pet 16, which may be used to pry the invention 10 from the lip 22 of the can 24.

Depending into the central cover member 12 and outer cover member 14, the invention includes a plurality of concentric annular bands 18 of various sizes so as to encircle snugly the lip 22 of the pet food can 24, which has a circular opening of the same diameter as the encircling annular band 18.

Figure 6:
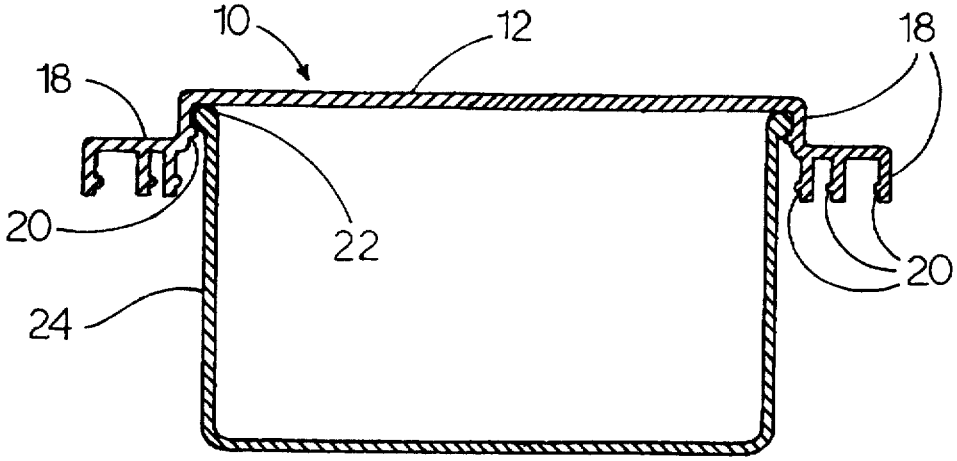
FIG. 6 is a side elevational view in section of the invention and a can, with the invention shown fitted to the can.
Figure 7:
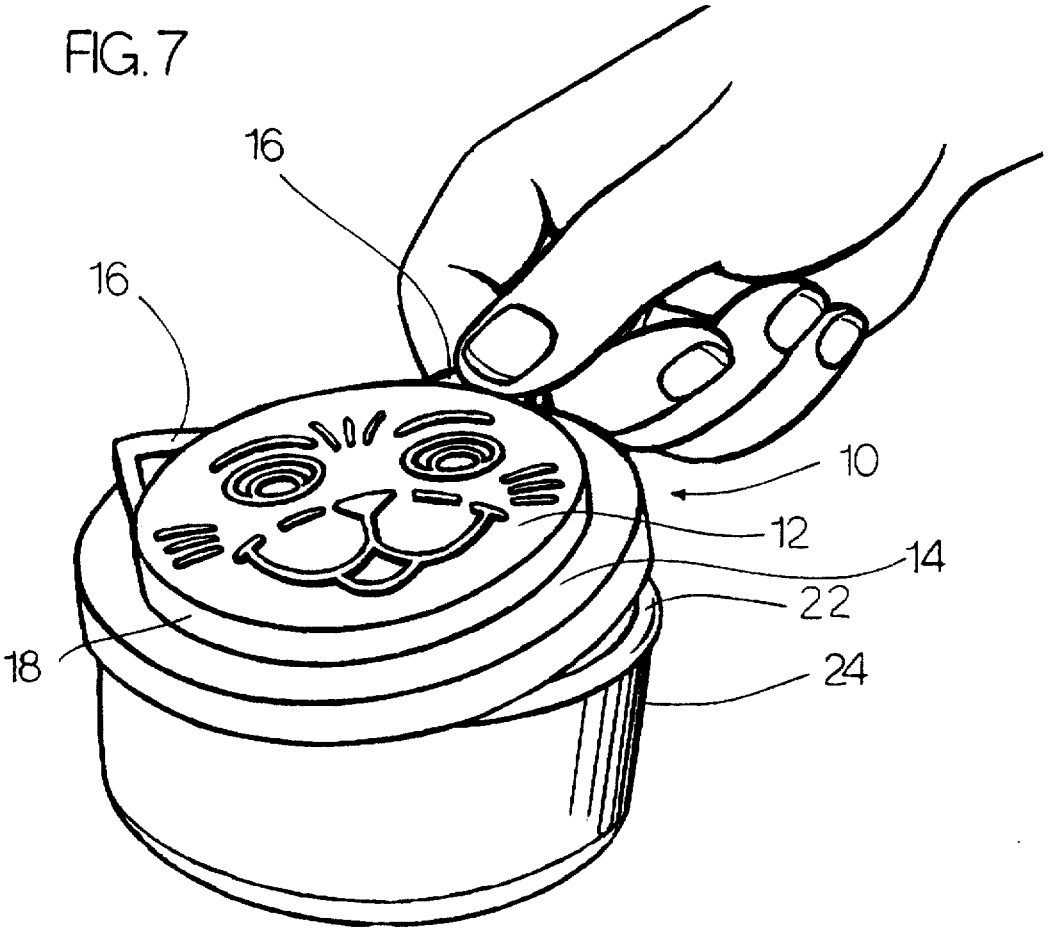
FIG. 7 shows the invention being pried from a can by the hand of a user.
Figure 8:
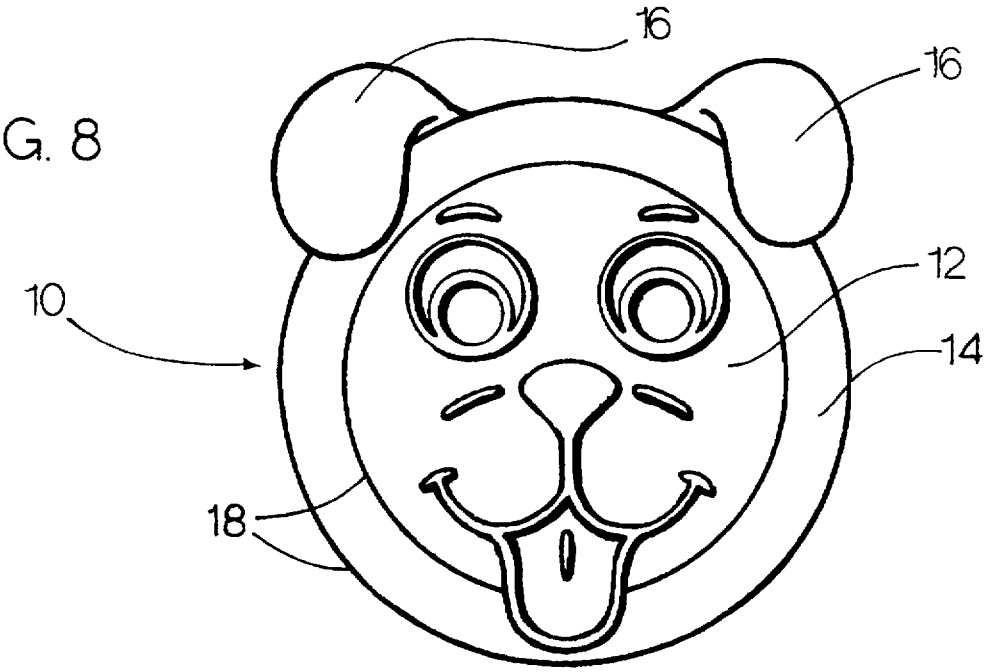
FIG. 8 is a frontal view of an alternative embodiment of the invention.

As seen in FIG. 6, the central cover member 12 and outer cover member 14 are positioned on different levels, separated in elevation from each other, with annular bands 18 downwardly extending from both levels. Such an arrangement allows annular bands 18 of very similar diameter to be included within the same device 10 and to encircle the lip 22 of the can 24 without hinderance.

Each band 18 includes along its inner surface, an inwardly extending bead or rib 20, which provides an interference fit that allows the band to snap tightly into place when pushed onto the lip 22 of the can 24 by the user.

SUMMARY, RAMIFICATIONS, AND SCOPE

The invention disclosed herein provides a single device which closes and seals a variety of pet food cans with openings of different diameters. Said device satisfies the need to protect the contents from rapid spoilage and provides a stable grip of the pet food cans so as to eliminate the likelihood of accidental spillage of contents during storage or handling.

The applicant's invention integrates a decorative surface which is formed in the shape of a pet, providing several advantages. Firstly, the pet shape has protruding features which may be grasped between the fingers of the user, allowing the user to easily pry the closure device from the can. Secondly, the pet shape helps to readily identify the contents of the can, as a cat shaped device may be used for cat food cans while a dog shaped device may be used to close dog food cans. Thirdly, the integrated pet shape also provides an important commercial value in that it increases the marketing appeal of the closure device. Additionally, the closure device may be used for decoration or amusement.

The specificities contained in the above description should not be construed as limitations of the scope of the invention, but rather as providing examples of the presently preferred embodiments of the invention. Many variations are possible. Accordingly, the scope of the invention should not be determined by the embodiments illustrated, but by the appended claims and their legal equivalents.

What is claimed is:

1. A closure device for covering containers having various sized diameters with an outer lip comprising:

a lid having an upwardly facing surface and a downwardly facing surface, said upwardly facing surface shaped to resemble an animal, concentric annular bands of various diameters depending downwardly from said downwardly facing surface of the lid, each annular band having an annular rib or bead extending inwardly, each annular rib or bead of each annular band fitting to engage the outer lip of a corresponding sized container, said lid having an outer periphery, a pair of lifting tabs extending radially beyond said outer periphery and axially above said annular ribs or beads, said tabs being formed into the likeness of the ears of said animal, said ears being molded in one piece with said lid.

* * * * *